US006364850B1

(12) United States Patent
Wang

(10) Patent No.: US 6,364,850 B1
(45) Date of Patent: Apr. 2, 2002

(54) MASSAGE DEVICE CAPABLE OF PERFORMING COMBINED TAPPING AND KNEADING MASSAGING ACTIONS

(76) Inventor: Kuo-An Wang, No. 77, Sec. 1, Ling-An Rd., Tainan City (TW)

( * ) Notice: Subject to any disclaimer, the term of this patent is extended or adjusted under 35 U.S.C. 154(b) by 0 days.

(21) Appl. No.: 09/708,922

(22) Filed: Nov. 8, 2000

(51) Int. Cl.[7] ..... A61H 7/00

(52) U.S. Cl. ..... 601/98; 601/101; 601/102; 601/90; 601/94

(58) Field of Search ..... 601/97, 98, 99, 601/101, 102, 103, 115, 116, 122, 126, 90, 92, 93, 94

(56) References Cited

U.S. PATENT DOCUMENTS 4,615,336 A * 10/1986 Fijimoto ..... 128/52
4,718,408 A * 1/1988 Barreiro ..... 128/52
5,052,376 A * 10/1991 Yamasaki ..... 128/52
5,179,940 A * 1/1993 Barreiro ..... 128/33
5,464,382 A * 11/1995 Wang ..... 601/99
5,877,570 A * 3/1999 Chen ..... 310/75 R
5,971,944 A * 10/1999 Chang ..... 601/90
6,099,487 A * 8/2000 Chen ..... 601/90
6,283,928 B1 * 9/2001 Wang ..... 601/99

* cited by examiner

*Primary Examiner*—Jeanette Chapman
*Assistant Examiner*—Benjamin K. Koo
(74) *Attorney, Agent, or Firm*—Ladas & Parry

(57) ABSTRACT

In a massage device, a rotary drive shaft is disposed uprightly in a hollow casing. Parallel upper and lower output shafts are mounted transversely in the casing, and have opposite end portions that extend out of the casings. An upper gear set includes an upper drive gear sleeved rigidly on the drive shaft for co-rotation therewith, and an upper driven gear meshing with the upper drive gear and connected rigidly to the upper output shaft. A lower gear set includes a lower drive gear disposed coaxially on the drive shaft, and a lower driven gear meshing with the lower drive gear and connected rigidly to the lower output shaft. A unidirectional bearing is disposed between the drive shaft and the lower drive gear to prevent rotation of the drive shaft from being transmitted to the lower output shaft when the drive shaft rotates in a first direction, while permitting rotation of the drive shaft to be transmitted to the lower output shaft when the drive shaft rotates in a second direction opposite to the first direction. Two linkage units, disposed on the lateral sides of the casing, are mounted on the end portions of the output shafts and are provided with massaging wheels.

3 Claims, 7 Drawing Sheets

MASSAGE DEVICE CAPABLE OF PERFORMING COMBINED TAPPING AND KNEADING MASSAGING ACTIONS

BACKGROUND OF THE INVENTION

1. Field of the Invention

The present invention relates to a massage device for a chair-type massage apparatus, more particularly to a massage device capable of performing combined tapping and kneading massaging actions.

2. Description of the Related Art

FIG. 1 illustrates a massage apparatus for mounting in the backrest of a chair. The massage apparatus includes a parallel pair of upright guiding rails 111 extending upwardly from on a horizontal platform 112, a screw rod 12 mounted rotatably on the platform 12 and extending upwardly there from and a slide seat 13 mounted on the screw rod 12 and slidable upwardly and downwardly along the guiding rails 111. A first motor 16 is mounted on the platform 112 for driving rotation of the screw rod 12. A conventional massage device 2 is mounted on the slide frame 13, and is driven by a second motor 14 mounted on the slide frame 13.

With further reference to FIG. 2, the conventional massage device 2 includes two casing halves which cooperatively form a hollow casing 21, and a rotary drive shaft 221 disposed uprightly in the hollow casing 21 and coupled to the second motor 14 by means of a pulley 17 and a transmission belt 141 disposed on the pulley 17. The drive shaft 221 is driven by the second motor 14 to rotate axially in the hollow casing 2. The casing 2 has horizontal upper and lower output shafts 231, 232 extending transversely therethrough. An upper gear set includes an upper drive gear 225 sleeved co-axially on the drive shaft 221, and an upper driven gear 233 meshing with the upper drive gear 225 and sleeved rigidly on the upper output shaft 231. A lower gear set includes a lower drive gear 226 sleeved co-axially on the drive shaft 221, and a lower driven gear 234 meshing with the lower drive gear 226 and sleeved rigidly on the lower output shaft 232. A first unidirectional bearing 223 is disposed between the drive shaft 221 and the upper drive gear 225, and is operable to transmit rotation in only a first direction. A second unidirectional bearing 224 is disposed between the drive shaft 221 and the lower drive gear 226, and is operable to transmit rotation in only a second direction opposite to the first direction. Two linkage units 24 are disposed on opposite sides of the hollow casing 21. Each linkage unit 24 has an upper linking plate 241 connected pivotally to the upper output shaft 231 at one end and mounted rotatably with a massage wheel 243 at the other end, a lower linking rod 242 with a lower end connected pivotally to the lower output shaft 232, and an upper end mounted pivotally on an intermediate portion of the linking plate 241.

When the drive shaft 221 is rotated in the first direction, the first unidirectional bearing 223 engages and rotates with the drive shaft 221 to cause corresponding rotation of the upper output shaft 231 via the upper gear set, whereas the second unidirectional bearing 224 prevents rotation of the drive shaft 221 from being transmitted to the lower gear set. Rotation of the upper output shaft 231 causes the upper linking plates 241 to move reciprocatingly to enable the massaging wheels 243 to exert a kneading massaging action on the back of a user seated on the chair that incorporates the massage device 2. On the other hand, when the drive shaft 221 is rotated in the second direction, the second unidirectional bearing 224 engages and rotates with the drive shaft 221 to cause corresponding rotation of the lower output shaft 232 via the lower gear set, whereas the first unidirectional bearing 223 prevents rotation of the drive shaft 221 from being transmitted to the upper gear set. Rotation of the lower output shaft 232 causes the lower linking rod 242 to move reciprocatingly and to push and pull the upper linking plate 241 so as to enable the massaging wheels 243 to exert a tapping massaging action on the back of the user. It is noted that the tapping massaging action and the kneading massaging action are performed separately by driving the drive shaft 221 to rotate in opposite directions. When performing the tapping massaging action, each of the massaging wheels 243 taps at a certain area on the back of the user, and thus moves along a linear route during upward or downward sliding of the slide frame 13 along the guiding rails 111, as shown in FIG. 3. It is desirable to diversify the massaging action performed by the massage device and to expand the area on which the massaging action is exerted.

SUMMARY OF THE INVENTION

Therefore, the main object of the present invention is to provide a massage device capable of performing combined tapping and kneading massaging actions.

Accordingly, the massage device of the present invention includes a hollow casing, a drive shaft, parallel upper and lower output shafts, upper and lower gear sets, a unidirectional bearing, a pair of linkage units, and a pair of massaging wheels. The drive shaft is disposed uprightly in the hollow casing, and is rotatable axially in opposite first and second directions. The upper and lower output shafts are disposed transversely in the hollow casing, and have opposite end portions that extend out of the hollow casing and that are disposed respectively on opposite lateral sides of the hollow casing. The upper gear set includes an upper drive gear sleeved rigidly on the drive shaft so as to be co-rotatable with the drive shaft in the first and second directions, and an upper driven gear meshing with the upper drive gear and connected rigidly to the upper output shaft so as to permit rotation of the upper output shaft together with the drive shaft when the drive shaft rotates in each of the first and second directions. The lower gear set includes a lower drive gear disposed coaxially on the drive shaft below the upper drive gear, and a lower driven gear meshing with the lower drive gear and connected rigidly to the lower output shaft. The unidirectional bearing is provided on the drive shaft, and is disposed between the drive shaft and the lower drive gear. The unidirectional bearing prevents rotation of the drive shaft from being transmitted to the lower output shaft when the drive shaft rotates in the first direction, and permits rotation of the drive shaft to be transmitted to the lower output shaft via the lower gear set when the drive shaft rotates in the second direction. The linkage units are disposed respectively on the lateral sides of the hollow casing, and are mounted on the end portions of the upper and lower output shafts. The massaging wheels are mounted respectively on the linkage units.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
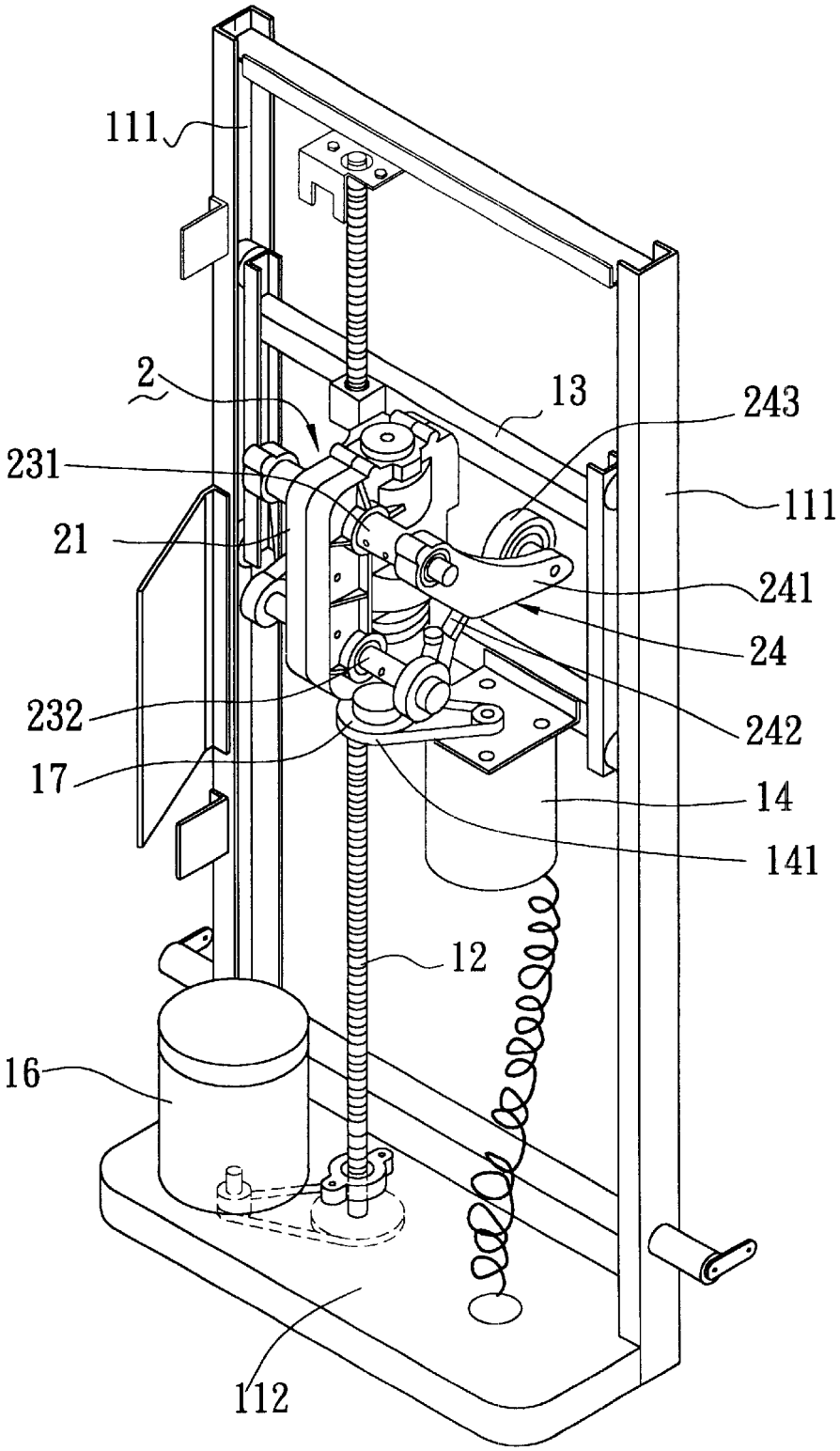
FIG. 1 PRIOR ART
FIG. 1 is a perspective view showing a massage apparatus incorporating a conventional massage device.
Figure 2:
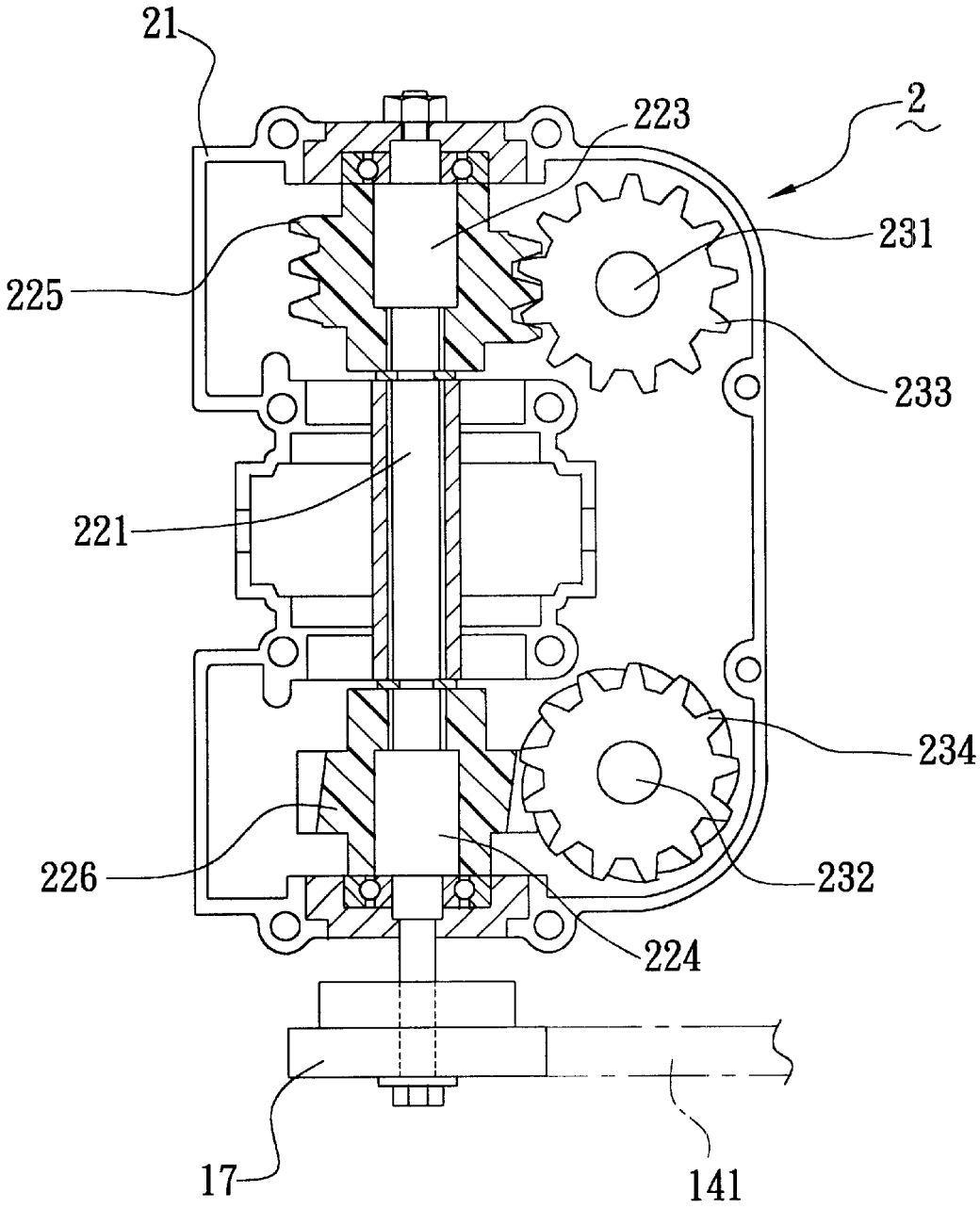
FIG. 2 PRIOR ART
FIG. 2 is a partly sectional view showing the conventional massage device.
Figure 3:
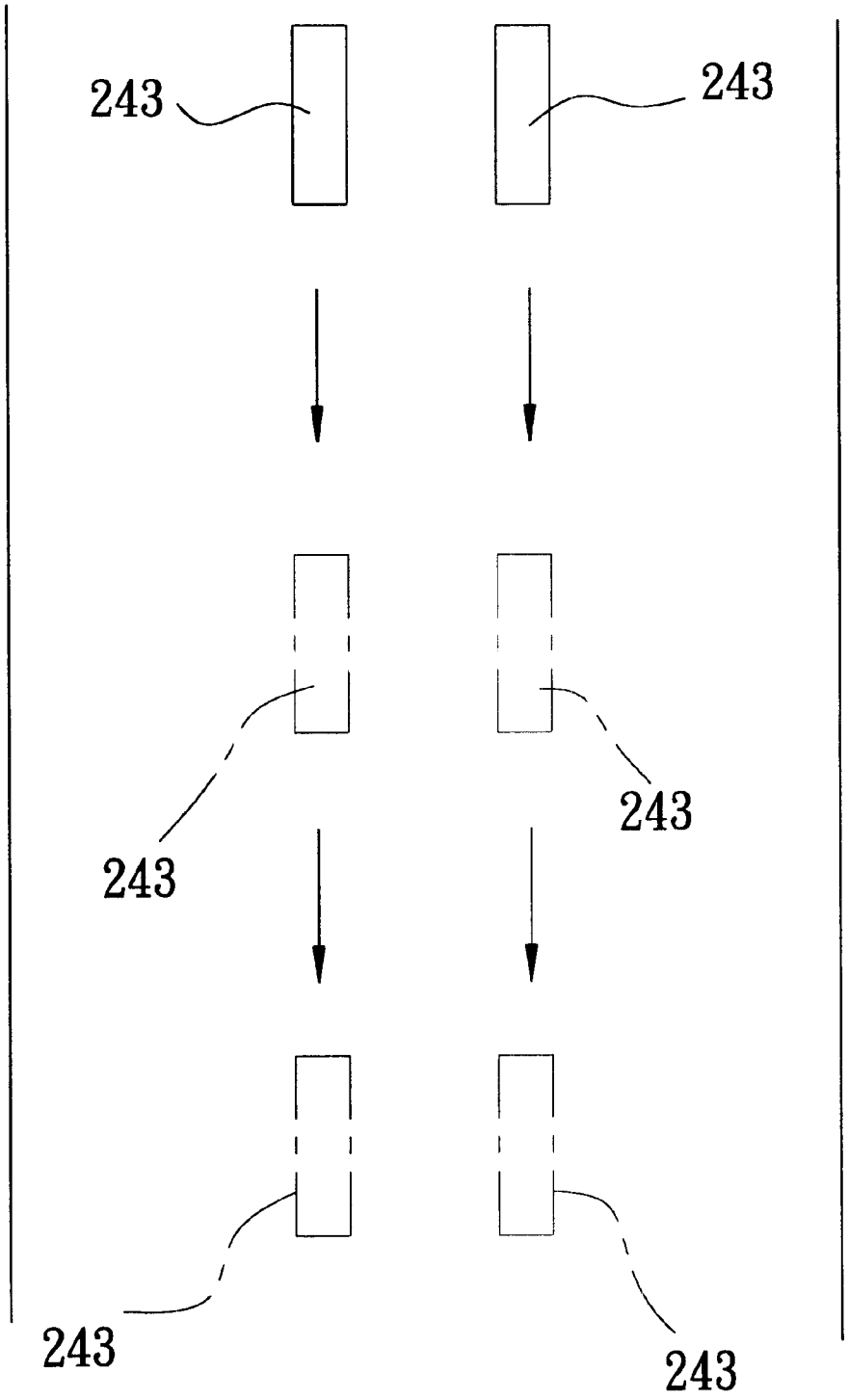
FIG. 3 PRIOR ART
FIG. 3 illustrates the route of a pair of massaging wheels of the massage device during a tapping massaging action while the massage device slides downwardly.
Figure 4:
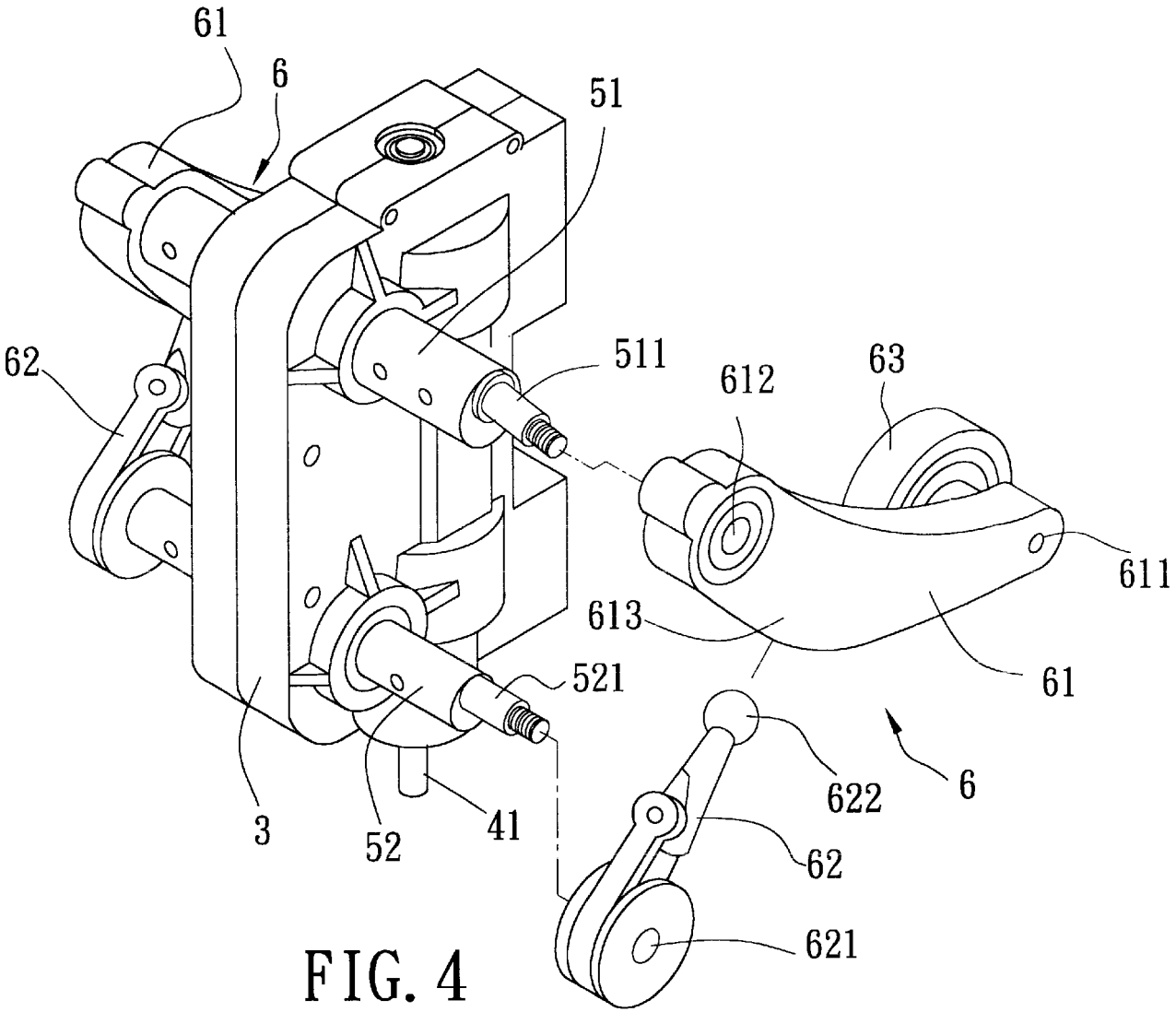
FIG. 4 is a partly exploded perspective view illustrating a preferred embodiment of the massage device of the present invention.
Figure 5:
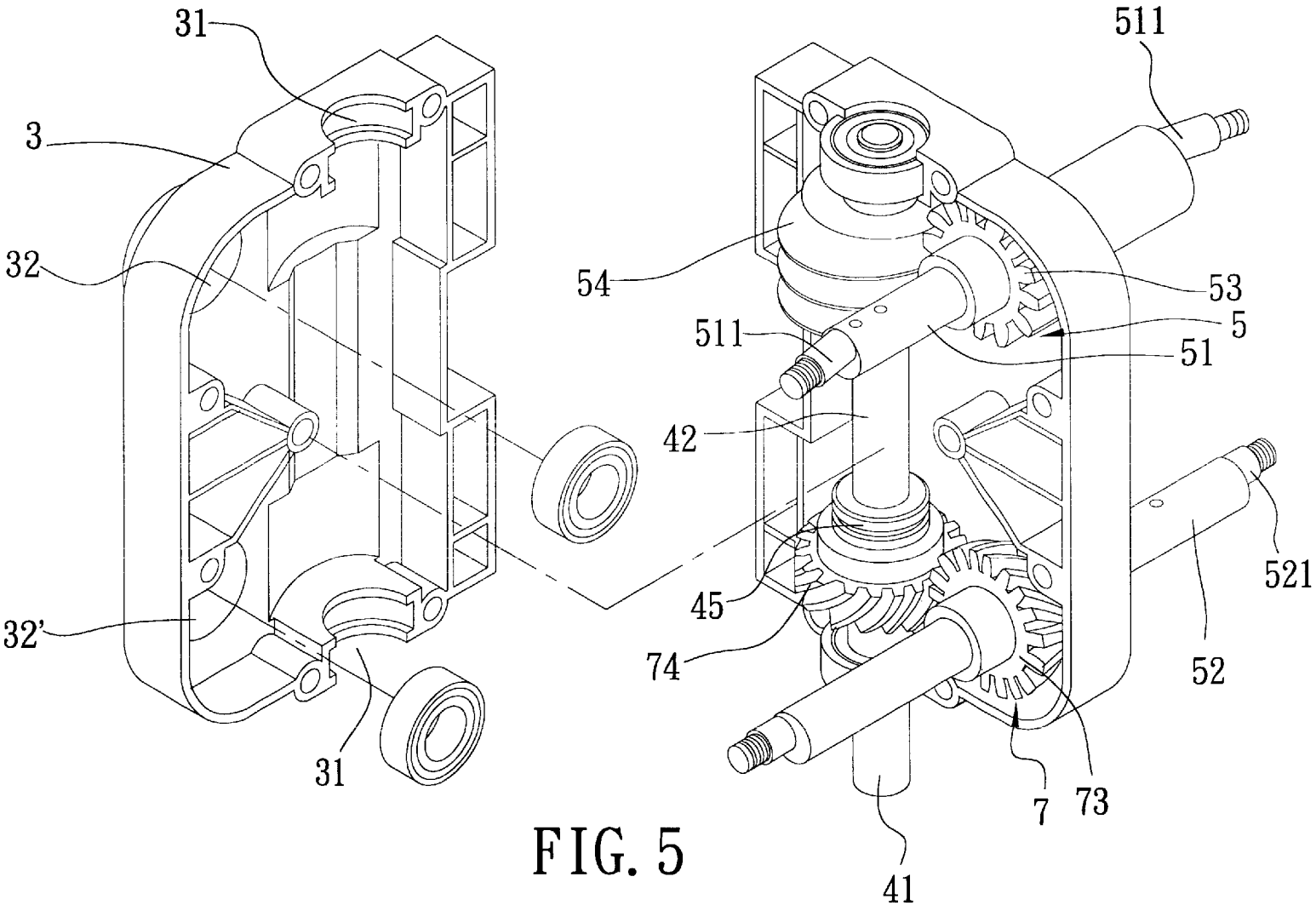
FIG. 5 is another partly exploded perspective view of the preferred embodiment, where a pair of linkage units and a pair of massaging wheels are omitted for the sake of clarity.

Referring to FIGS. 4 and 5, the preferred embodiment of the massage device of the present invention is adapted for use in a chair-type massage apparatus which is to be installed in a backrest of a chair. The massage device of the preferred embodiment is shown to include a hollow casing 3, a drive shaft 41, parallel upper and lower output shafts 51, 52, upper and lower gear sets 5, 7 disposed in the casing 3, a pair of linkage units 6, and a pair of massaging wheels 63 (only one is visible in FIG. 4).

The hollow casing 3 includes a pair of casing halves, and is formed with vertically aligned axial holes 31 through top and bottom walls thereof. The drive shaft 41 is disposed uprightly and is mounted rotatably on the hollow casing 3 at the axial holes 31. The drive shaft 41 has a lower end projecting downwardly from the hollow casing 3 and coupled to a transmission unit 411 (see FIG. 6) so as to be driven by a motor (not shown) for rotating the drive shaft 41 axially in opposite first and second directions. The drive shaft 41 has a sleeve member 42 sleeved on an intermediate section thereof.

The upper output shaft 51 is disposed transversely in the hollow casing 3, and has two opposite end portions extending out of the hollow casing 3 via a pair of upper mounting holes 32 formed in the casing halves. The end portions of the upper output shaft 51 are disposed on two opposite lateral sides of the hollow casing 3, and are each formed with an eccentric coupling shaft 511 which is inclined relative to an axis of the upper output shaft 51.

The lower output shaft 52 is disposed transversely in the hollow casing 3, and has two opposite end portions extending out of the hollow casing 3 via a pair of lower mounting holes 32' formed in the casing halves. The end portions of the lower output shaft 52 are disposed on the lateral sides of the hollow casing 3, and are each formed with an eccentric coupling shaft 521.

Figure 6:
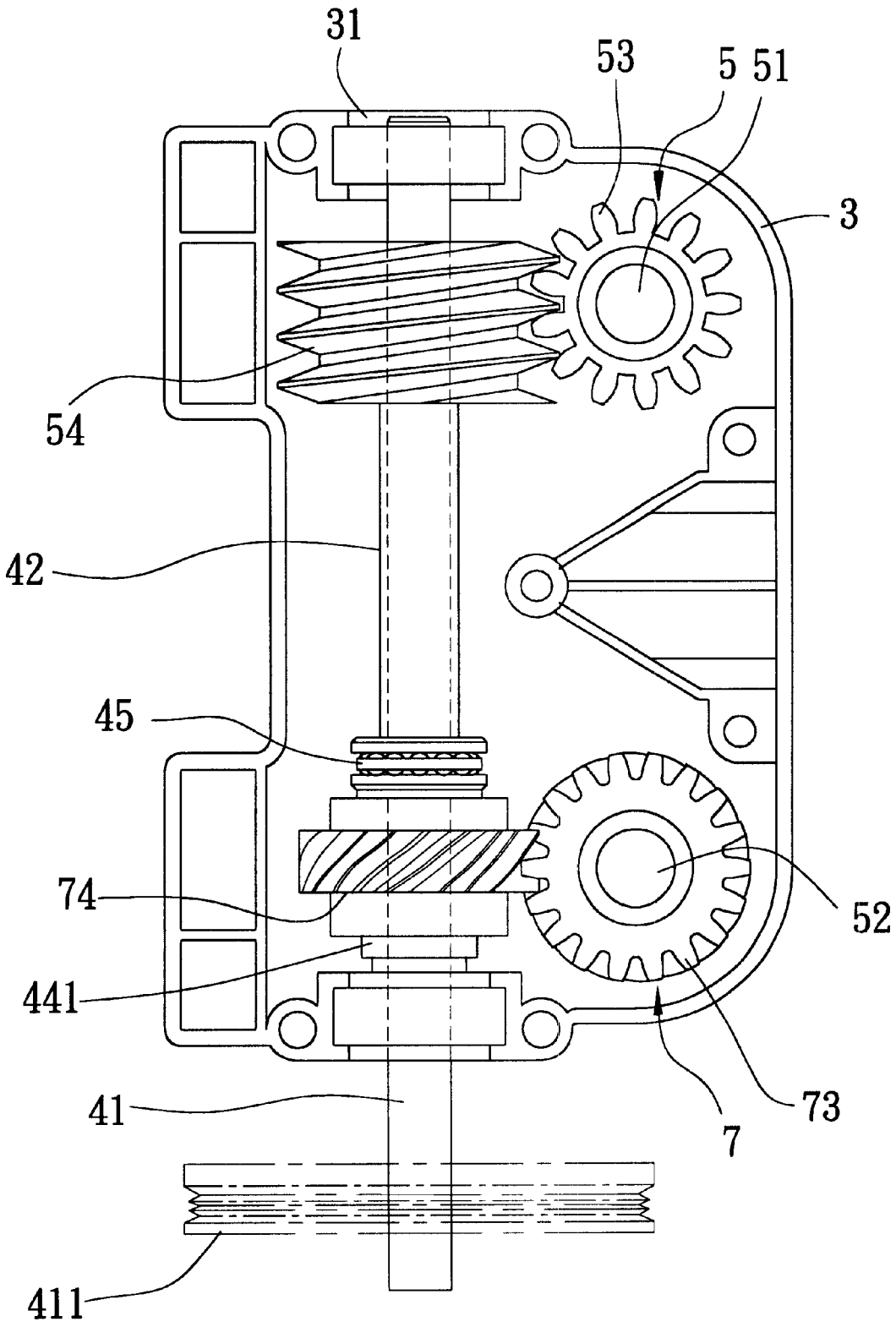
FIG. 6 is a schematic view illustrating an interior of the preferred embodiment.

Referring to FIGS. 5 and 6, the upper gear set 5 includes an upper drive gear 54 sleeved rigidly on an upper section of the drive shaft 41 for co-rotation with the drive shaft 41 in the first and second directions, and an upper driven gear 53 meshing with the upper drive gear 54 and sleeved rigidly on the upper output shaft 51. The upper gear set 5 can thus transmit rotation of the drive shaft 41 to the upper output shaft 51 when the drive shaft 41 rotates in either of the first and second directions.

The lower gear set 7 includes a lower drive gear 74 sleeved co-axially on a lower section of the drive shaft 241, and a lower driven gear 73 meshing with the lower drive gear 74 and sleeved rigidly on the lower output shaft 52. A thrust bearing 45 is sleeved on the drive shaft 41, and is disposed between the sleeve member 42 and the lower drive gear 74. A unidirectional bearing 441 is sleeved on the drive shaft 41, and is disposed between the drive shaft 41 and the lower drive gear 74. When the drive shaft 41 rotates in the first direction, the unidirectional bearing 441 prevents rotation of the drive shaft 41 from being transmitted to the lower drive gear 74, and to the lower driven gear 73 and the lower output shaft 52. Accordingly, when the drive shaft 41 rotates in the second direction, the unidirectional bearing 441 engages the drive shaft 41 with the lower drive gear 74, thereby permitting co-rotation of the lower drive gear 74 with the drive shaft 41 and permitting rotation of the drive shaft 41 to be transmitted to the lower driven gear 73 and the lower output shaft 52. Therefore, when the drive shaft 41 rotates in the first direction, only the upper output shaft 51 is driven to rotate. However, when the drive shaft 41 rotates in the second direction, both the upper and lower output shafts 51, 52 are driven to rotate about their respective axes.

Referring back to FIG. 4, each of the linkage units 6 is disposed on a respective one of the lateral sides of the hollow casing 3, and includes an upper linking member 61 and lower linking member 62. The upper linking member 61 has a first end 612 mounted pivotally on the eccentric coupling shaft 511 of a respective one of the end portions of the upper output shaft 51, and a distal second end 611 opposite to the first end 612 and having a respective one of the massaging wheels 63 mounted rotatably thereon. The lower linking member 62 has a lower end 621 mounted pivotally on the eccentric coupling shaft 521 of a respective one of the end portions of the lower output shaft 52, and an upper end 622 connected pivotally to an intermediate portion 613 of the upper linking member 61 between the first and second ends 612, 611 of the latter. It is noted that each of the massaging wheels 63 may be replaced with a massaging wheel unit having a V-shaped mounting plate mounted pivotally on the second end 611 of the upper linking member 61, and more than one massaging wheel mounted rotatably on opposite ends of the mounting plate.

In use, when the drive shaft 41 is driven by the motor to rotate axially in the first direction, the upper drive gear 54 engages the upper driven gear 53 to cause corresponding rotation of the upper output shaft 51. Since the upper linking member 61 of each of the linkage units 6 is pivoted to the eccentric coupling shaft 511 on the respective end portion of the upper output shaft 51, rotation of the upper output shaft 51 causes the upper linking members 61 to move back and forth. Moreover, since the coupling shafts 511 are inclined relative to the axis of the upper output shaft 51, the angle between the upper output shaft 51 and each of the upper linking members 61 varies during the back-and-forth movement of the upper linking members 61, thereby moving the massaging wheels 63 toward and away from each other. The massaging wheels 63 are thus capable of exerting a kneading massaging action on the spine of a user seated on the chair that incorporates the massage device. The thrust bearing 45 can minimize friction between the sleeve member 42 and the unidirectional bearing 441 to prevent undesirable driving of the lower drive gear 74 at this time.

Figure 7:
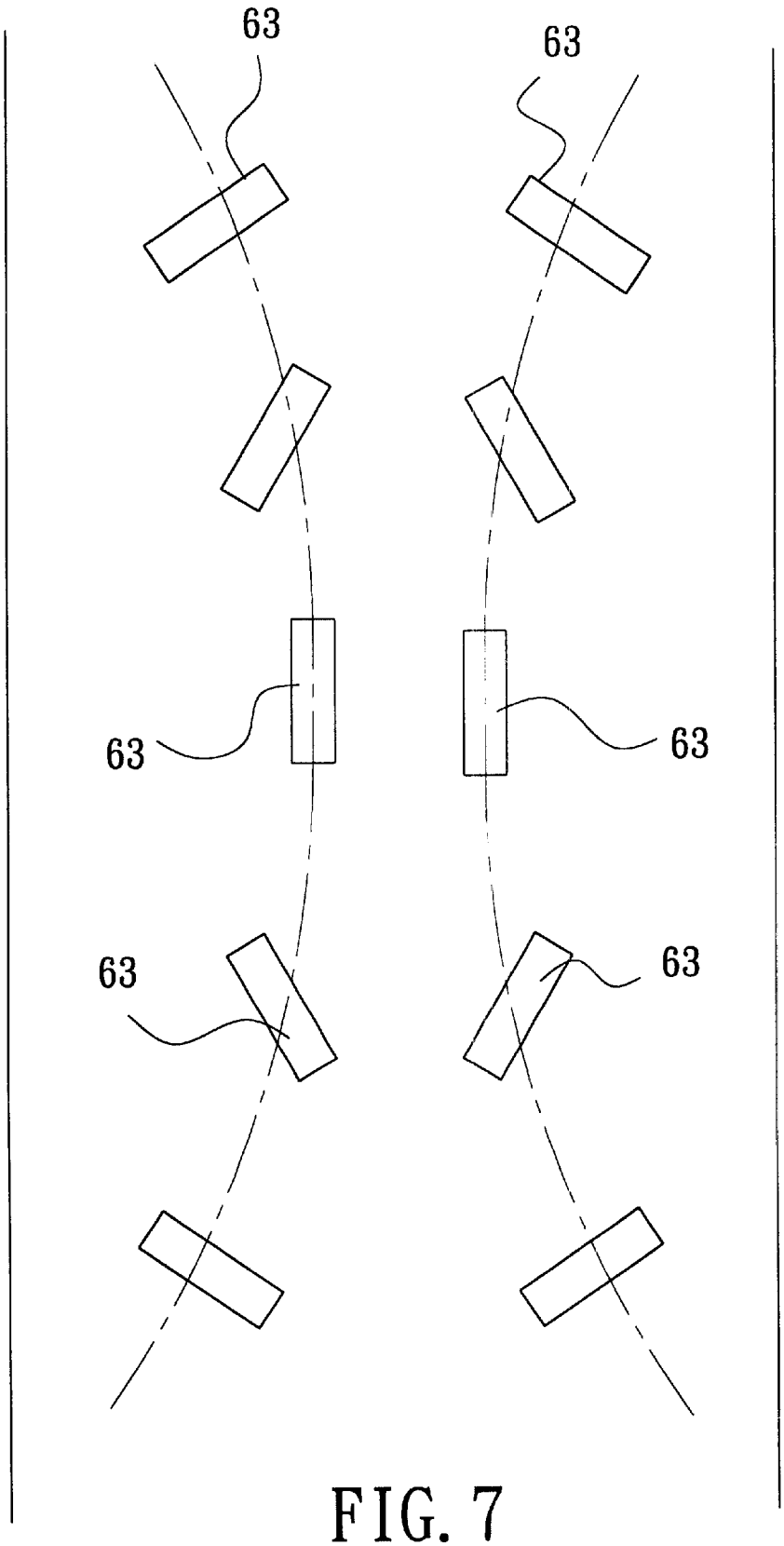
FIG. 7 illustrates the route of a pair of massaging wheels of the massage device of the preferred embodiment during a tapping massaging action.

When the drive shaft 41 is driven to rotate axially in the second direction, the unidirectional bearing 441 is capable of transmitting rotation of the drive shaft 41 to the lower drive gear 74, which in turn, transmits the rotation to the lower output shaft 52 via the lower driven gear 73. Since the lower linking member 62 of each of the linkage units 6 is pivoted to the eccentric coupling shaft 521 on the respective end portion of the lower output shaft 52, rotation of the lower output shaft 52 causes the lower linking members 62 to move reciprocatingly and to push and pull the upper linking members 61 due to the connection between the lower and upper linking members 62, 61, thereby enabling the massaging wheels 63 to move upwardly and downwardly so as to exert a tapping massaging action on the spine of the user. Since the upper drive gear 54 is sleeved rigidly on the drive shaft 41, the upper output shaft 51 is also driven by the drive shaft 41 to rotate axially at this time. The massaging wheels 63 thus simultaneously exert the tapping massaging action and the kneading massaging action in combination. During upward and downward sliding movement of the massage device along the backrest of the chair while the drive shaft 41 is rotated in the second direction to perform the combined tapping and kneading massaging actions, the massaging wheels 63 move along curved routes, as best illustrated in FIG. 7. As shown, the area on which the massaging wheels 63 exert the combined tapping and kneading massaging actions is remarkably larger in comparison with that using the aforementioned conventional massage device to perform the tapping massaging action.

While the present invention has been described in connection with what is considered the most practical and preferred embodiment, it is understood that this invention is not limited to the disclosed embodiment but is intended to cover various arrangement included within the spirit and scope of the broadest interpretation so as to encompass all such modifications and equivalent arrangements.

I claim:

1. A massage device comprising:

a hollow casing with two opposite lateral sides;

a drive shaft disposed uprightly in said hollow casing and rotatable axially in opposite first and second directions;

parallel upper and lower output shafts disposed transversely in said hollow casing, each of said output shafts having two opposite end portions that extend out of said hollow casing and that are disposed respectively on said lateral sides of said hollow casing;

an upper gear set which includes an upper drive gear sleeved rigidly on said drive shaft so as to be co-rotatable with said drive shaft in the first and second directions, and an upper driven gear meshing with said upper drive gear and connected rigidly to said upper output shaft so as to permit rotation of said upper output shaft together with said drive shaft when said drive shaft rotates in each of the first and second directions;

a lower gear set which includes a lower drive gear disposed coaxially on said drive shaft below said upper drive gear, and a lower driven gear meshing with said lower drive gear and connected rigidly to said lower output shaft;

a unidirectional bearing provided on said drive shaft and disposed between said drive shaft and said lower drive gear, said unidirectional bearing preventing rotation of said drive shaft from being transmitted to said lower output shaft when said drive shaft rotates in the first direction, said unidirectional bearing permitting rotation of said drive shaft to be transmitted to said lower output shaft via said lower gear set when said drive shaft rotates in the second direction;

a pair of linkage units disposed respectively on said lateral sides of said hollow casing and mounted on said end portions of said upper and lower output shafts; and a pair of massaging wheels mounted respectively on said linkage units.

2. The massage device as claimed in claim 1, wherein each of said linkage units includes:

an upper linking member having a first end connected pivotally and eccentrically to a respective one of said end portions of said upper output shaft, a second end opposite to said first end, and an intermediate portion between said first and second ends; and a lower linking member having a lower end connected pivotally and eccentrically to a respective one of said end portions of said lower output shaft, and an upper end connected pivotally to said intermediate portion of said upper linking member;

each of said massaging wheels being mounted rotatably on said second end of said upper linking member of the respective one of said linkage units.

3. The massage device as claimed in claim 1, further comprising a sleeve member sleeved on said drive shaft between said upper and lower drive gears, and a thrust bearing sleeved on said drive shaft between said sleeve member and said lower drive gear.

* * * * *